US010309274B2

(12) United States Patent
Yano et al.

(10) Patent No.: US 10,309,274 B2
(45) Date of Patent: Jun. 4, 2019

(54) VARIABLE VALVE MECHANISM FOR ENGINE

(71) Applicant: TOYOTA JIDOSHA KABUSHIKI KAISHA, Toyota-shi (JP)

(72) Inventors: Toshiyuki Yano, Nagakute (JP); Yu Yokoyama, Okazaki (JP); Yuta Nishimura, Toyota (JP); Atsuhisa Tamano, Anjo (JP); Soichiro Suga, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/823,765

(22) Filed: Nov. 28, 2017

(65) Prior Publication Data

US 2018/0179921 A1 Jun. 28, 2018

(30) Foreign Application Priority Data

Dec. 26, 2016 (JP) ..... 2016-250730

(51) Int. Cl.
*F01L 1/18* (2006.01)
*F01L 13/00* (2006.01)
(Continued)

(52) U.S. Cl.
CPC ..... *F01L 13/0036* (2013.01); *F01L 1/08* (2013.01); *F01L 1/185* (2013.01); *F01L 1/053* (2013.01); *F01L 1/2405* (2013.01); *F01L 2001/0537* (2013.01); *F01L 2001/34496* (2013.01); *F01L 2013/0052* (2013.01); *F01L 2013/0078* (2013.01); *F01L 2013/101* (2013.01); *F01L 2105/00* (2013.01); *F01L 2810/00* (2013.01)

(58) Field of Classification Search
CPC ..... F01L 2001/0473; F01L 1/053; F01L 1/08; F01L 1/185; F01L 1/267; F01L 1/46; F01L 2013/0052
USPC ..... 123/90.18, 90.27, 90.6
See application file for complete search history.

(56) References Cited

U.S. PATENT DOCUMENTS 5,095,859 A * 3/1992 Iwata ..... F01L 1/267 123/308
5,228,419 A * 7/1993 Nonogawa ..... F01L 1/053 123/90.22

(Continued)

FOREIGN PATENT DOCUMENTS

DE 10 2005 006 489 A1 8/2006
JP 2010-520395 6/2010

(Continued)

*Primary Examiner* — Jorge L Leon, Jr.
(74) *Attorney, Agent, or Firm* — Oblon, McClelland, Maier & Neustadt, L.L.P.

(57) ABSTRACT

For example, two intake valves for each cylinder each are driven by a selected one of cams via a corresponding rocker arm. Each rocker arm includes a support portion and a pressing portion (distal end portion). The support portion is rockably supported by a cylinder head. The pressing portion is configured to press a stem of the corresponding intake valve. The support portion of one of the rocker arms deviates to one side in an axis X direction (cam axial direction) with respect to the distal end portion. The support portion of the other one of the rocker arms deviates to the other side in the axis X direction with respect to the distal end portion.

5 Claims, 8 Drawing Sheets

(51) Int. Cl.

| | |
|---|---|
| ***F01L 1/08*** | (2006.01) |
| *F01L 1/053* | (2006.01) |
| *F01L 1/24* | (2006.01) |
| *F01L 1/344* | (2006.01) |

(56) References Cited

U.S. PATENT DOCUMENTS

| | | | | |
|---|---|---|---|---|
| 5,596,958 | A * | 1/1997 | Miller | F01L 1/053 123/193.5 |
| 6,340,010 | B1 * | 1/2002 | Hara | F01L 1/267 123/90.16 |
| 2010/0269769 | A1 | 10/2010 | Schoeneberg et al. | |
| 2013/0025571 | A1 * | 1/2013 | Ashizawa | F01L 3/085 123/48 R |
| 2014/0102391 | A1 | 4/2014 | Kappler et al. | |
| 2016/0208661 | A1 | 7/2016 | Tomoda et al. | |

FOREIGN PATENT DOCUMENTS

| | | |
|---|---|---|
| JP | 2014-077443 | 5/2014 |
| JP | 2016-130507 | 7/2016 |

* cited by examiner

VARIABLE VALVE MECHANISM FOR ENGINE

INCORPORATION BY REFERENCE

The disclosure of Japanese Patent Application No. 2016-250730 filed on Dec. 26, 2016 including the specification, drawings and abstract is incorporated herein by reference in its entirety.

BACKGROUND

1. Technical Field

The disclosure relates to a variable valve mechanism that is used in a valve actuating system of an engine and, more particularly, to a cam-changing variable valve mechanism configured to select any one of a plurality of cams by sliding a cam unit, fitted around a camshaft, in an axial direction (hereinafter, also referred to as cam axial direction).

2. Description of Related Art

Conventionally, there is known a cam-changing variable valve mechanism as a variable valve mechanism that is able to change the lift characteristic of each intake valve of an engine, as described in, for example, Japanese Patent Application Publication No. 2010-520395 (JP 2010-520395 A). In the cam-changing variable valve mechanism, a cam carrier (cam unit) including a plurality of cams is fitted around an intake camshaft. The cam-changing variable valve mechanism is configured to select any one of the cams by sliding the cam carrier in the axial direction. In this example, two intake valves are provided for each cylinder of the engine, and each intake valve is driven by the selected one of the cams via a corresponding rocker arm.

That is, the cam carrier for each cylinder, fitted around the intake camshaft, includes the plurality of cams having mutually different heights in correspondence with each of the two intake valves. When the cam unit is caused to slide in the cam axial direction, any one of the cams presses the corresponding rocker arm. In addition, a spiral guide groove is provided on the outer periphery of the cam carrier. When a shift pin is engaged with the guide groove from the outer side, the cam carrier slides in the cam axial direction while rotating with the rotation of the camshaft.

SUMMARY

The structure of such a valve actuating system will be described with reference to FIG. 2. In each rocker arm 15, a proximal end support portion 15*b* is supported by a cylinder head (not shown) via a lash adjuster 16, while a distal end portion 15*c* (pressing portion) presses the top of a stem 10*a* of a corresponding intake valve 10. A roller 15*a* provided at the middle of the rocker arm 15 is, for example, pressed by a low-lift cam 41, and the distal end portion 15*c* rocks downward to cause the intake valve 10 to open.

When the rocker arms 15 that rock in that way are viewed from above, the rocker arms 15 are ordinarily arranged substantially parallel to the corresponding cams 41, that is, perpendicular to the cam axial direction (axis X). However, actually, due to manufacturing tolerances, or the like, the cams 41 (indicated by the imaginary lines) can be slightly inclined with respect to the corresponding rocker arms 15 (the inclination angle is denoted by θ in the drawing) as exaggeratedly shown in FIG. 7. For this reason, when each cam 41 rotates to press the corresponding rocker arm 15, the cam 41 is dragged in the direction of the axis X (not shown in FIG. 7) under the friction resistance between the cam 41 and the rocker arm 15.

That is, when each cam 41 presses the corresponding rocker arm 15, the cam 41 receives reaction force from a valve spring 18 via the rocker arm 15. However, when the rocker arm 15 and the cam 41 are inclined with respect to each other as described above, the valve spring reaction force that acts on the cam 41 and, by extension, the cam unit 4, via the rocker arm 15 includes a component in the axis X direction. Therefore, an unexpected slide of the cam unit 4 can occur.

The disclosure reduces occurrence of an unexpected slide of a cam unit due to reaction force from a valve spring in a variable valve mechanism configured to change the lift characteristic of a valve by sliding the cam unit.

In an aspect of the disclosure, for example, when two intake valves are provided for each cylinder, valve spring reaction forces of the two intake valves act on the corresponding cam unit in opposite directions along the cam axial direction, thus cancelling out sliding forces. Specifically, the aspect of the disclosure provides a variable valve mechanism mounted on an engine. The variable valve mechanism includes a cam unit and rocker arms. The cam unit is fitted around a camshaft. The cam unit includes two sets of a plurality of cams. Any one of the plurality of cams is selected by sliding the cam unit in an axial direction. The engine may be a multi-cylinder engine.

Two intake valves or two exhaust valves or both are provided for each cylinder. Each of the two intake valves or two exhaust valves or both is configured to be driven by the selected one of the cams via a corresponding one of the rocker arms. Each rocker arm includes a support portion rockably supported by a cylinder head of the engine, and a pressing portion configured to press a stem of a corresponding one of the valves. The support portion of any one of the two rocker arms for each cylinder deviates to one side in the axial direction with respect to the corresponding pressing portion. The support portion of the other one of the rocker arms deviates to the other side in the axial direction with respect to the corresponding pressing portion.

With the thus configured variable valve mechanism, when the cylinder is viewed from above the cylinder head, the cams are slightly inclined with respect to the corresponding rocker arms due to manufacturing tolerances, so, as described with reference to FIG. 7, valve spring reaction forces that act on the cams via the rocker arms and, by extension, the cam unit, include a component in the cam axial direction. Ordinarily, two sets of a plurality of cams in a cam unit are ground at the same time as one, so forces tend to act in the same direction along the cam axial direction from the two rocker arms.

However, with the above configuration, the two rocker arms for each cylinder are intentionally not arranged perpendicularly to the cam axial direction but slightly inclined with respect to the cam axial direction, and the orientations of the inclined two rocker arms are opposite to each other. That is, as described above, the support portion of any one of the rocker arms deviates to one side in the cam axial direction with respect to the pressing portion, and the support portion of the other one of the rocker arms deviates to the other side in the cam axial direction with respect to the pressing portion (see FIG. 8) on the contrary.

With such inclined arrangement of the two rocker arms, forces respectively act on the two cams for each cylinder from the rocker arms in opposite directions along the cam axial direction. That is, a force from one of the rocker arms is headed toward one side in the cam axial direction, and a force from the other one of the rocker arms is headed toward the other side in the cam axial direction. Forces in the cam axial direction, which respectively act on the two cams for each cylinder due to valve spring reaction forces, cancel out each other in this way, so it is possible to suppress a slide of each cam unit.

A structure for inclining the two rocker arms for each cylinder in mutually opposite directions may be as follows. When the cylinder head includes, for each cylinder, mounting holes for mounting lash adjusters that respectively support the two rocker arms and insertion holes through which stems of the two valves are inserted, a distance between centers of the two mounting holes may be longer than a distance between centers of the two insertion holes.

That is, generally, the layout of the two valves for each cylinder of the engine is determined on the basis of the configuration of combustion chambers. Thus, the layout of the insertion holes for the stems of the valves is also determined. For this reason, when the distance between the mounting holes for the two lash adjusters is set so as to be longer than the distance between the two insertion holes, determined in this way, as described above, it becomes easy to avoid interference between the mounting holes and intake ports, and the flexibility of the shape and layout of the intake ports increases.

In order to suppress a drag of each cam under the friction resistance between the cam and the corresponding rocker arm as described above, a relatively small-diameter section may be formed in at least part of an angular range corresponding to the exhaust stroke of each cylinder in a base circle section of the cam. With this configuration, the friction resistance between the cam and the corresponding rocker arm reduces in the small-diameter section, so a drag of each cam is suppressed. In the exhaust stroke of a cylinder, even when the degree of sealing of the valve decreases in the small-diameter section, no inconvenience occurs.

According to the aspect of the disclosure, in the variable valve mechanism for an engine, configured to change the lift characteristic of each valve by sliding the cam unit, when two intake valves or two exhaust valves or both are provided for each cylinder, valve spring reaction forces are caused to act on the cam unit in opposite directions along the cam axial direction by arranging the corresponding rocker arms such that the rocker arms are inclined in opposite directions. Thus, it is possible to suppress occurrence of an unexpected slide of the cam unit due to valve spring reaction forces.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
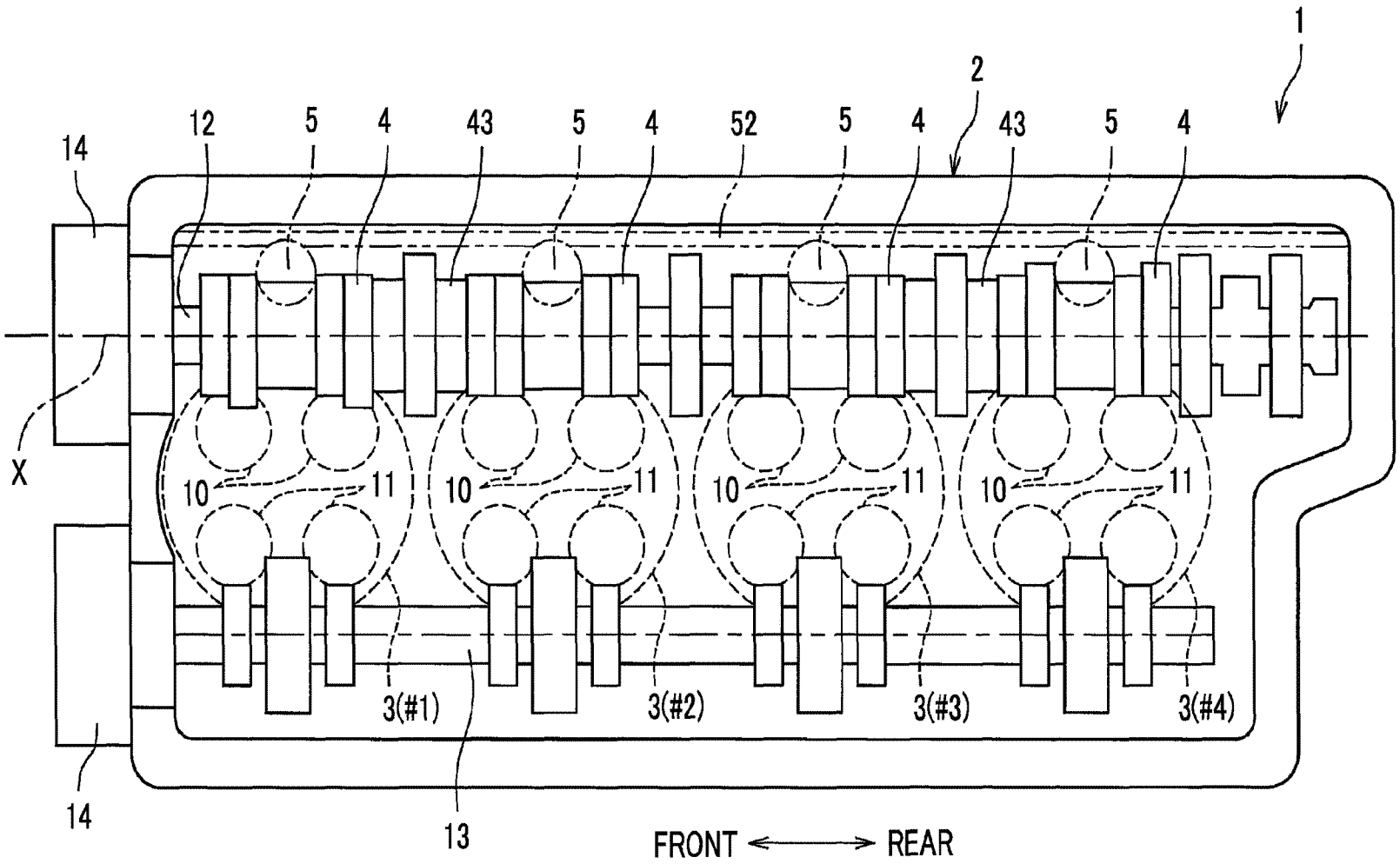
FIG. 1 is a schematic configuration view of a valve actuating system for an engine in which a variable valve mechanism according to an embodiment of the disclosure is provided.

Hereinafter, an embodiment in which the disclosure is applied to a valve actuating system for an engine will be described. The engine 1 according to the present embodiment is, for example, an in-line four-cylinder gasoline engine 1. As schematically shown in FIG. 1, four first to fourth cylinders 3 (#1 to #4) are arranged in the longitudinal direction of a cylinder block (not shown), that is, the front-to-rear direction (the horizontal direction of FIG. 1 indicated by the arrow) of the engine 1. In the following description, the front-to-rear direction of the engine 1 may be simply referred to as front-to-rear.

As shown from above in FIG. 1, a valve actuating system for intake valves 10 and a valve actuating system for exhaust valves 11 are arranged on the upper portion of the engine 1, that is, the upper portion of the cylinder head 2. That is, as indicated by the dashed lines in FIG. 1, the two intake valves 10 and the two exhaust valves 11 are provided for each of the four cylinders 3 arranged in line in the front-to-rear direction of the engine 1. The intake valves 10 are driven by an intake camshaft 12. The exhaust valves 11 are driven by an exhaust camshaft 13.

A variable valve timing (VVT) 14 is provided at the front end (left end in FIG. 1) of the intake camshaft 12, and another variable valve timing (VVT) 14 is provided at the front end of the exhaust camshaft 13. Each VVT 14 is able to continuously change valve timing. In addition, a cam changing mechanism (variable valve mechanism according to the aspect of the disclosure) is provided for each of the cylinders 3 on the intake camshaft 12. Each cam changing mechanism changes the lift characteristic of a corresponding one of the intake valves 10 by changing cams 41, 42 (see FIG. 2) for driving the intake valve 10.

Figure 2:
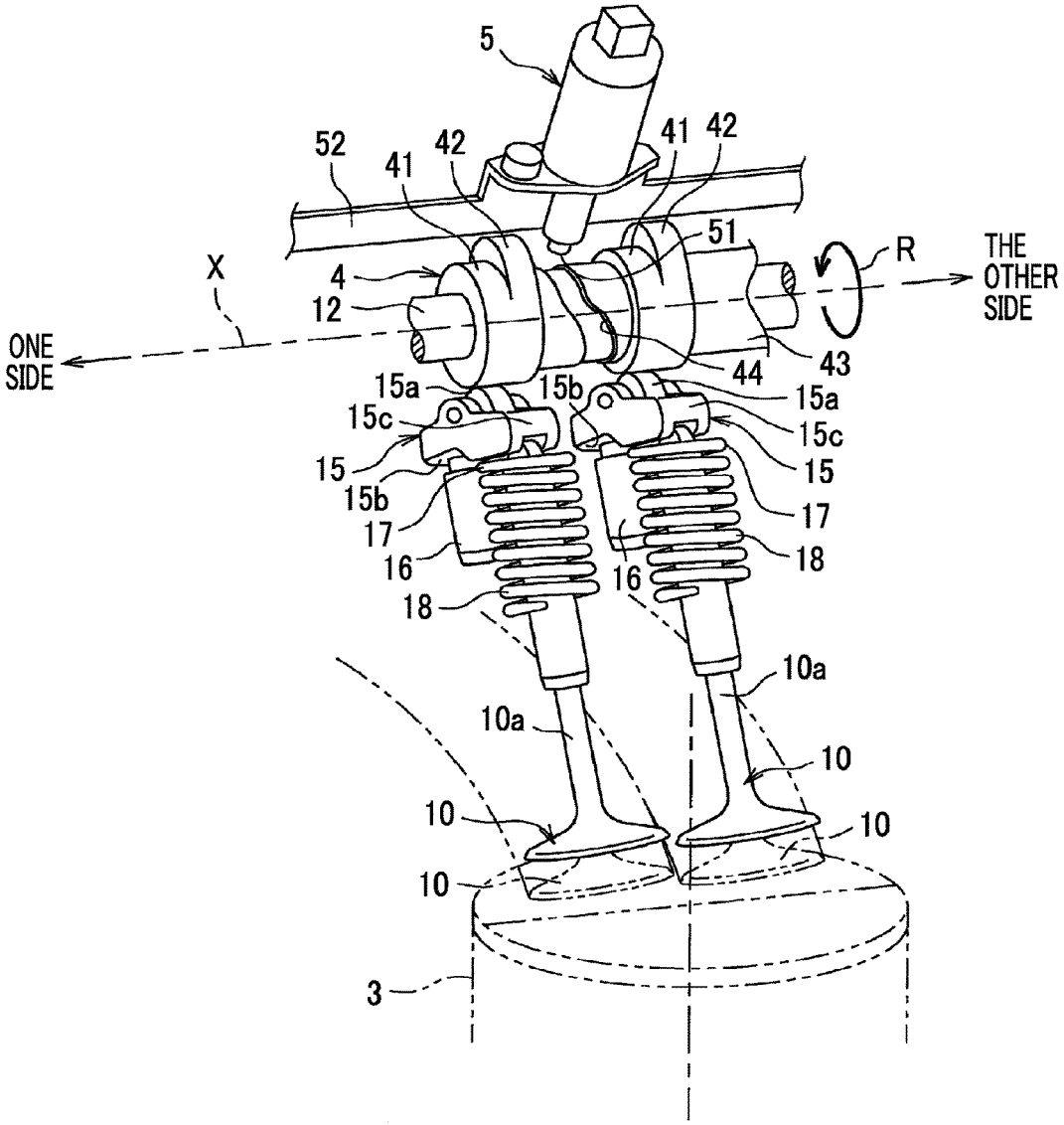
FIG. 2 is a perspective view that shows the basic configuration of an intake-side valve actuating system.

For example, the first cylinder 3 (#1) is shown in FIG. 2 in enlarged view. As shown in the drawing, the two cams 41, 42 having different profiles are provided in correspondence with each of the two intake valves 10 arranged in the direction of the axis X of the intake camshaft 12 (cam axial direction, engine front-to-rear direction) for each cylinder 3. The low-lift cam 41 and the high-lift cam 42 are arranged from the left (one side in the axis X direction) toward the right (the other side) in FIG. 2. Any one of the low-lift cam 41 and the high-lift cam 42 is selected, and the intake valve 10 is driven via a rocker arm 15.

The base circles of these low-lift cam 41 and high-lift cam 42 have the same diameter, and are formed into mutually continuous circular arc faces. FIG. 2 shows a state where the roller 15*a* of the rocker arm 15 is in contact with the base circle section of the low-lift cam 41. In the rocker arm 15, the proximal end support portion 15*b* is rockably supported by the cylinder head 2 (not shown in FIG. 2) via a lash adjuster 16, while the distal end portion 15*c* (pressing portion) presses the top of the stem 10*a* of the intake valve 10 via a retainer 17.

That is, each intake valve 10 is a common poppet valve. The retainer 17 is provided at the upper portion of the stem 10*a*, and receives upward pressing force from a valve spring 18. Thus, as indicated by the continuous lines in FIG. 2, the head of each intake valve 10 closes an intake port (indicated by the imaginary line). The stem 10*a* of each intake valve 10 is inserted through a valve guide 19 fixed to the cylinder head 2.

As shown in FIG. 2, when the roller 15*a* is in contact with the base circle section and the intake valve 10 is not lifted, the distal end portion 15*c* of the rocker arm 15 is almost not pressing the corresponding intake valve 10. As the intake camshaft 12 rotates in the direction indicated by the arrow R from this state, the low-lift cam 41 presses the roller 15*a* to push the rocker arm 15 downward although not shown in the drawing. Thus, each intake valve 10 is lifted as indicated by the imaginary line in FIG. 2 against reaction force from the corresponding valve spring 18.

Overall Configuration of Cam Changing Mechanism

Figure 4:
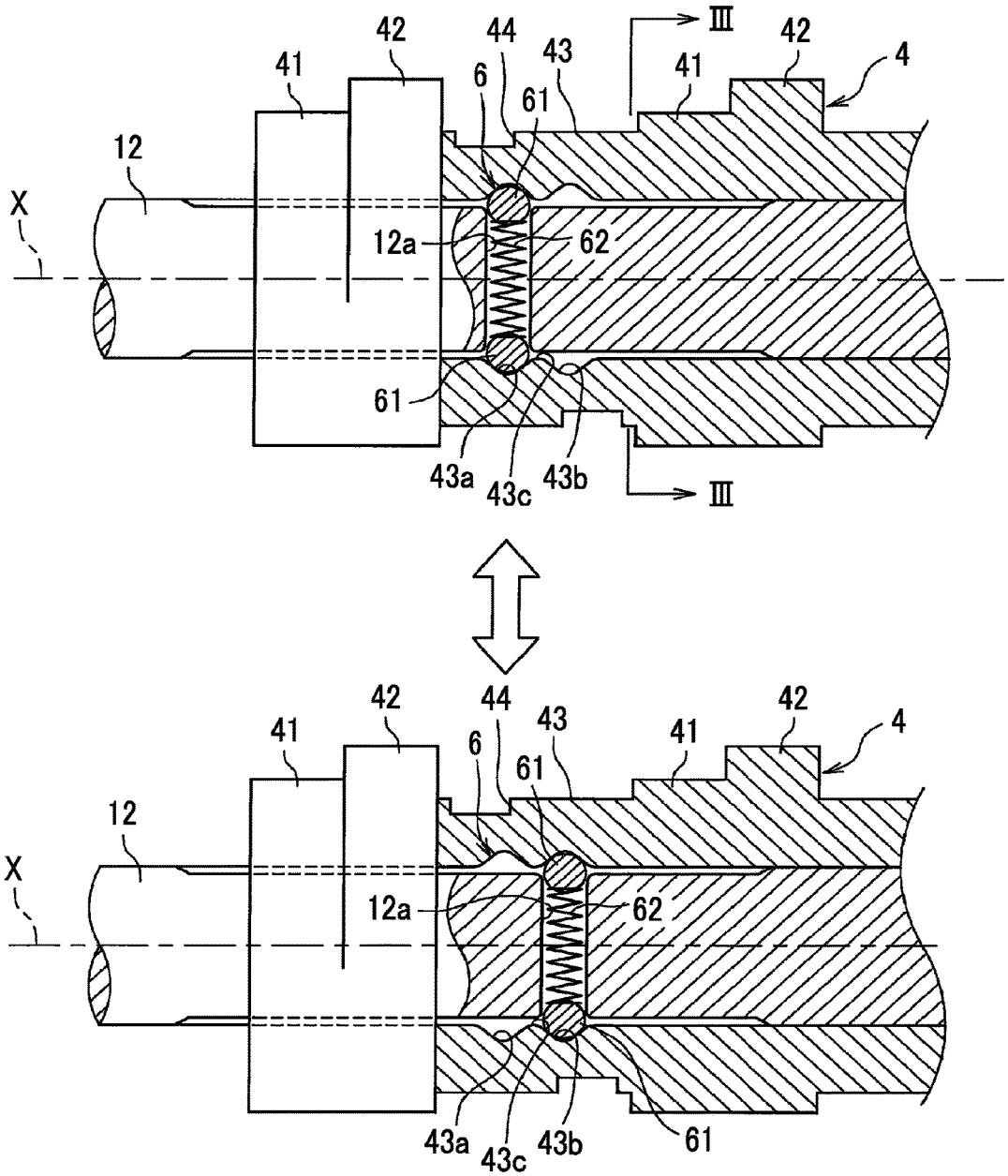
FIG. 4 is a partially sectional view that shows the structure of the cam unit.
Figure 5:
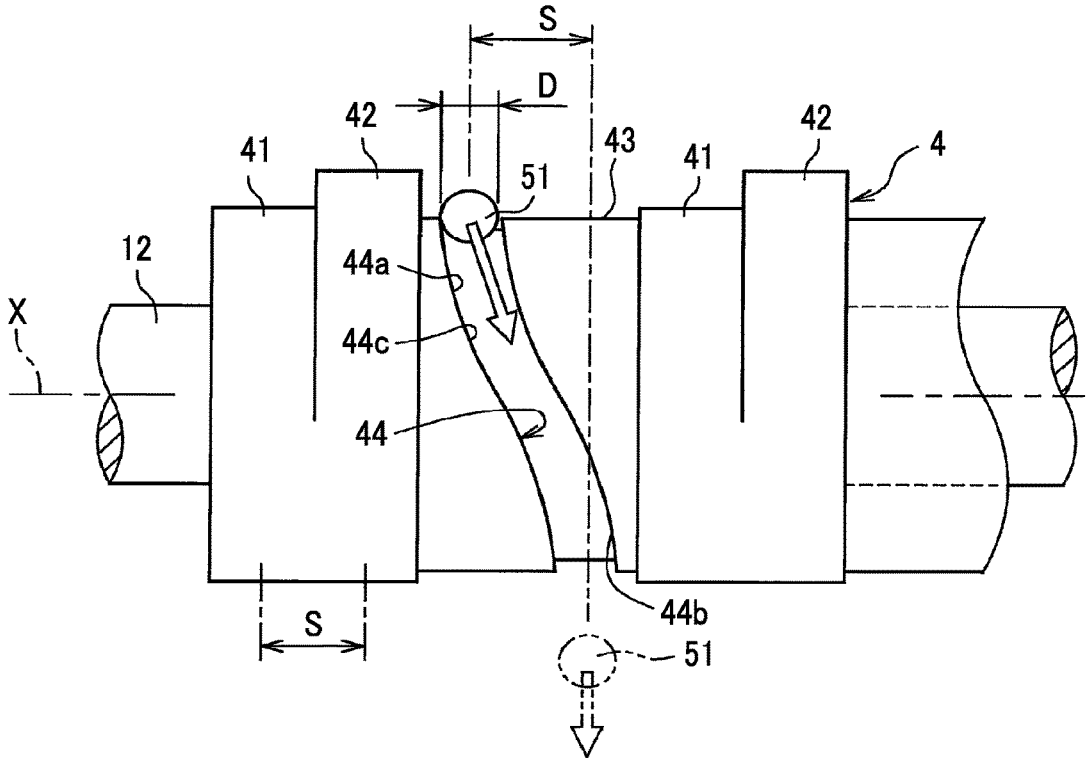
FIG. 5 is a view that illustrates the basic configuration of a cam changing mechanism that causes the cam unit to slide by engaging a shift pin with a guide groove.

In the present embodiment, the cam that lifts the intake valve 10 via the rocker arm 15 as described above is set to any one of the low-lift cam 41 and the high-lift cam 42. That is, as shown in FIG. 3 to FIG. 5 in addition to FIG. 2, in the present embodiment, the sets of two cams 41, 42 are integrally provided at predetermined locations of a cylindrical sleeve 43 to constitute the cam units 4, and the sleeve 43 is slidably fitted around the intake camshaft 12.

As shown only in FIG. 1, in the present embodiment, the long sleeve 43 extends over the first cylinder 3 (#1) and the second cylinder 3 (#2), and the sets of two cams 41, 42 are respectively provided at locations corresponding to the two intake valves 10 of each of these cylinders 3, that is, four locations in total. That is, the two cam units 4 for the first cylinder 3 (#1) and the second cylinder 3 (#2) are integrally coupled to each other by the single sleeve 43. This also applies to the third cylinder 3 (#3) and the fourth cylinder 3 (#4).

Figure 3:
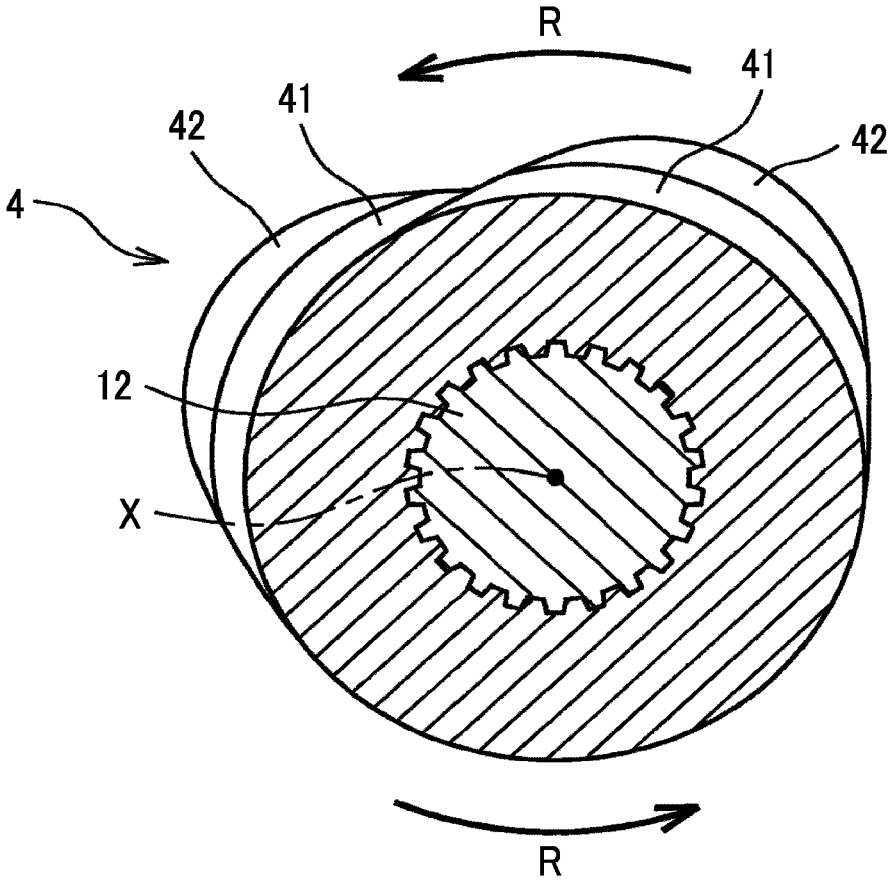
FIG. 3 is a cross-sectional view of a cam unit fitted around an intake camshaft.

FIG. 3 shows a cross section (cross section taken along the line III-HI in FIG. 4) near the middle of the cam unit 4 for the first cylinder (#1) in the axis X direction. As shown in FIG. 3, internal spline teeth are provided at the inner periphery of the sleeve 43, and are in mesh with external spline teeth provided at the outer periphery of the intake camshaft 12. That is, the cam units 4 (sleeve 43) are spline-coupled to the intake camshaft 12, and are configured to rotate integrally with the intake camshaft 12 and slide in the direction of the axis X.

In order to cause the cam units 4 to slide in that way, a guide groove 44 is provided at the outer periphery of the sleeve 43. A shift pin 51 is engaged with the guide groove 44 as will be described below. In the present embodiment, as shown in FIG. 2, FIG. 4, and the like, the clockwise spiral guide groove 44 is provided at the middle portion of the cam unit 4 for the first cylinder (#1) in the axis X direction. The guide groove 44 extends in the circumferential direction all around. Similarly, although not shown in the drawing, a counter-clockwise spiral guide groove is provided in the cam unit 4 for the second cylinder (#2).

An actuator 5 is arranged above the intake camshaft 12 in correspondence with each of the cylinders 3 and is supported by the cylinder head 2 via, for example, a stay 52 so that each shift pin 51 can be engaged with a corresponding one of the guide grooves 44. The stay 52 extends in the axis X direction. Each actuator 5 is configured to actuate a corresponding one of the shift pins 51 back and forth with the use of an electromagnetic solenoid. When the actuator 5 is in an on state, the shift pin 51 extends and engages with the guide groove 44.

For example, when the thus extended shift pin 51 is engaged with the guide groove 44, the shift pin 51 relatively moves in the circumferential direction on the outer periphery of the cam unit 4 and also moves in the axis X direction along the guide groove 44 (that is, obliquely) with the rotation of the intake camshaft 12, as will be described below additionally with reference to FIG. 6. At this time, actually, the cam unit 4 slides in the axis X direction while rotating.

More specifically, initially, as shown in FIG. 5, the guide groove 44 includes straight groove portions 44*a*, 44*b* and an S-shaped curved groove portion 44*c*. The straight groove portion 44*a* linearly extends in the circumferential direction at one side (left side in FIG. 5) in the axis X direction on the outer periphery of the cam unit 4. The straight groove portion 44*b* linearly extends in the circumferential direction at the other side (right side in FIG. 5) in the axis X direction on the outer periphery of the cam unit 4. The curved groove portion 44*c* connects these straight groove portions 44*a*, 44*b* with each other. As shown in FIG. 2, in the position in which the low-lift cam 41 is selected (low-lift position), the straight groove portion 44*a* at one side in the axis X direction faces the shift pin 51 of the actuator 5.

Figure 6:
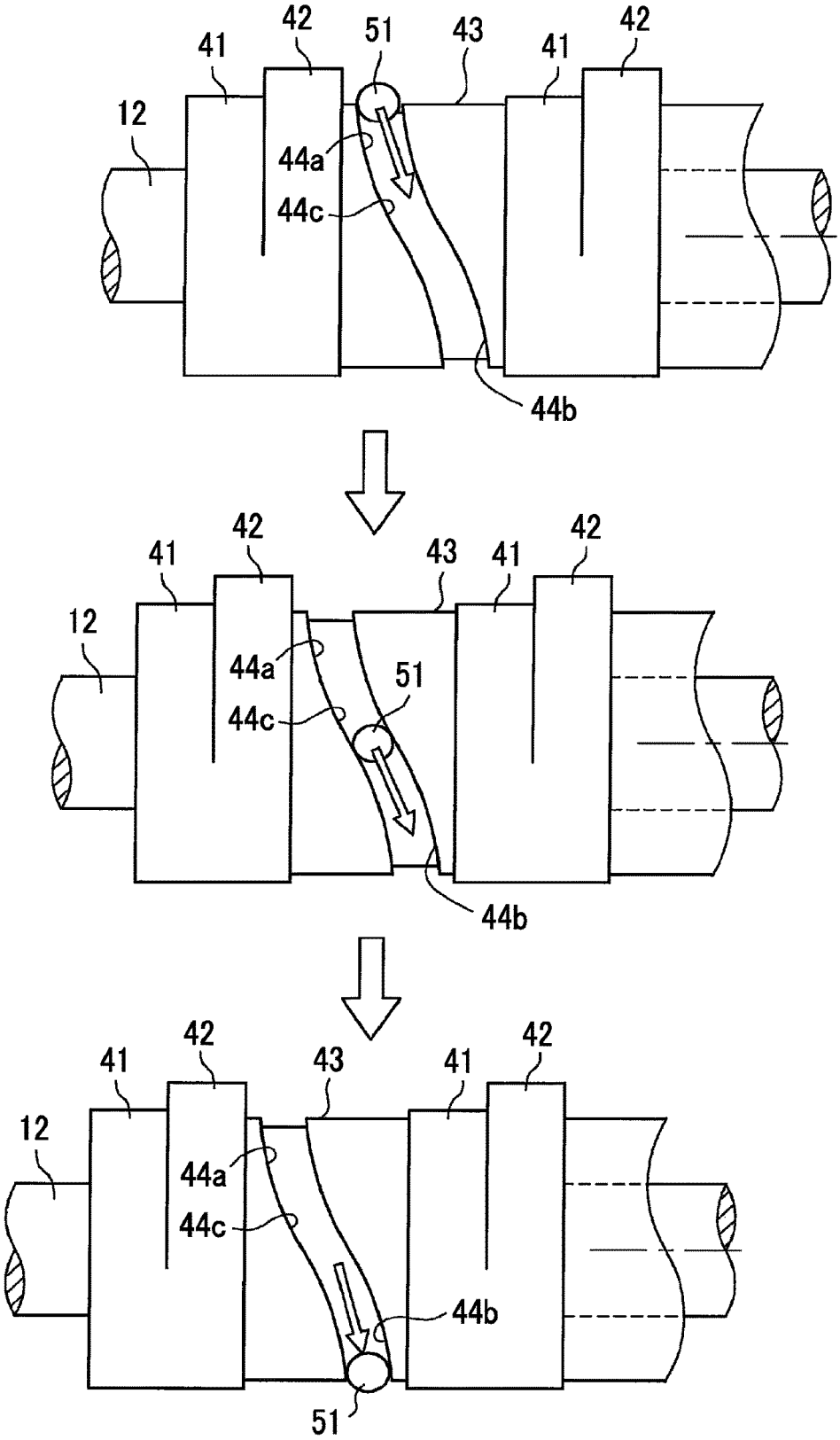
FIG. 6 is a view that illustrates the operation of the cam changing mechanism.

When the actuator 5 operates to cause the shift pin 51 to extend in this state, the shift pin 51 is engaged with the straight groove portion 44*a* located at one side of the guide groove 44 as shown in the top view of FIG. 6, and relatively moves downward in the drawing with the rotation of the intake camshaft 12. Then, as shown in the middle view of FIG. 6, the shift pin 51 reaches the curved groove portion 44*c*, and also moves to the other side in the axis X direction, that is, obliquely, while relatively moving downward in the drawing along the curved groove portion 44*c*.

Thus, actually, the shift pin 51 presses the cam unit 4 toward one side in the axis X direction to cause the cam unit 4 to slide, and switches the cam unit 4 into the position in which the high-lift cam 42 is selected (high-lift position). At this time, as shown in the bottom view of FIG. 6, the shift pin 51 reaches the straight groove portion 44*b* located at the other side of the guide groove 44, and, after that, leaves the guide groove 44. A sliding amount S of the cam unit 4 at the time of switching from the low-lift position to the high-lift position in this way is equal to the distance between the low-lift cam 41 and the high-lift cam 42 as shown in FIG. 5.

When the cam unit 4 is switched into the high-lift position as described above, the straight groove portion at the other side of the guide groove in the axis X direction, provided in the cam unit 4 for the second cylinder (#2), faces the shift pin 51 of the corresponding actuator 5 although not shown in the drawing. Then, by turning on the actuator 5 to cause the shift pin 51 to engage with the guide groove, it is possible to cause the cam unit 4 to slide to the other side in the axis X direction with the rotation of the intake camshaft 12 and move the cam unit 4 to the low-lift position similarly.

Lock Mechanism

In the present embodiment, a lock mechanism 6 is provided between each cam unit 4 and the intake camshaft 12. The lock mechanism 6 is used to hold the position of the cam unit 4 (the low-lift position or the high-lift position) at the time when the cams 41, 42 have been changed as described above. That is, as shown in FIG. 4, two annular grooves 43*a*, 43*b* are provided at the inner periphery of the sleeve 43 of each cam unit 4 side by side in the axis X direction (the horizontal direction of FIG. 4), and an annular protrusion 43*c* remains between the annular grooves 43*a*, 43*b*.

Two lock balls 61 are retractably arranged at the outer periphery of the intake camshaft 12 so as to be fitted to the annular groove 43*a* or the annular groove 43*b* when the cam unit 4 is in the low-lift position or the high-lift position. That is, in the present embodiment, a through-hole 12*a* extends through the intake camshaft 12 and opens at two locations on the outer periphery of the intake camshaft 12. The through-hole 12*a* has a circular cross section. The through-hole 12*a* accommodates the two lock balls 61 and a coil spring 62 inside.

Those two lock balls 61 are respectively arranged on both ends of the coil spring 62, and are urged by the spring force of the coil spring 62 so as to be pushed outward from openings at both ends of the through-hole 12*a*. Thus, when the cam unit 4 is in the low-lift position (the right-side position in FIG. 4) as shown in the top view of FIG. 4, the two lock balls 61 are fitted into the annular groove 43*a* to restrict a slide of the cam unit 4 and hold the cam unit 4 in the low-lift position.

On the other hand, when the cam unit 4 is in the high-lift position (the left-side position in FIG. 4) as shown in the bottom view of FIG. 4, the two lock balls 61 are fitted into the annular groove 43*b* to restrict a slide of the cam unit 4 and hold the cam unit 4 in the high-lift position. As described with reference to FIG. 6, when the cam unit 4, for example, slides from the low-lift position to the high-lift position, the lock balls 61 climb over the annular protrusion 43*c* and move from the annular groove 43*a* to the annular groove 43*b*.

At this time, as the cam unit 4 slides, the lock balls 61 are initially pushed by the annular protrusion 43*c*, move against the spring force of the coil spring 62, and leave the annular groove 43*a*. After climbing over the annular protrusion 43*c*, the lock balls 61 are fitted into the annular groove 43*b* under the spring force of the coil spring 62. This also applies to the case where the cam unit 4 slides from the high-lift position to the low-lift position.

Arrangement of Rocker Arms

Incidentally, with the structure that each cam unit 4 is slidably fitted around the intake camshaft 12 as in the case of the above-described cam changing mechanism, each cam unit 4 can slide due to reaction force from the valve springs 18 of the intake valves 10. That is, initially, as described with reference to FIG. 2, each rocker arm 15 rocks when the roller 15*a* provided at the middle portion of the rocker arm 15 is pressed by any one of the cams 41, 42, and causes the intake valve 10 to open via the retainer 17.

Figure 7:
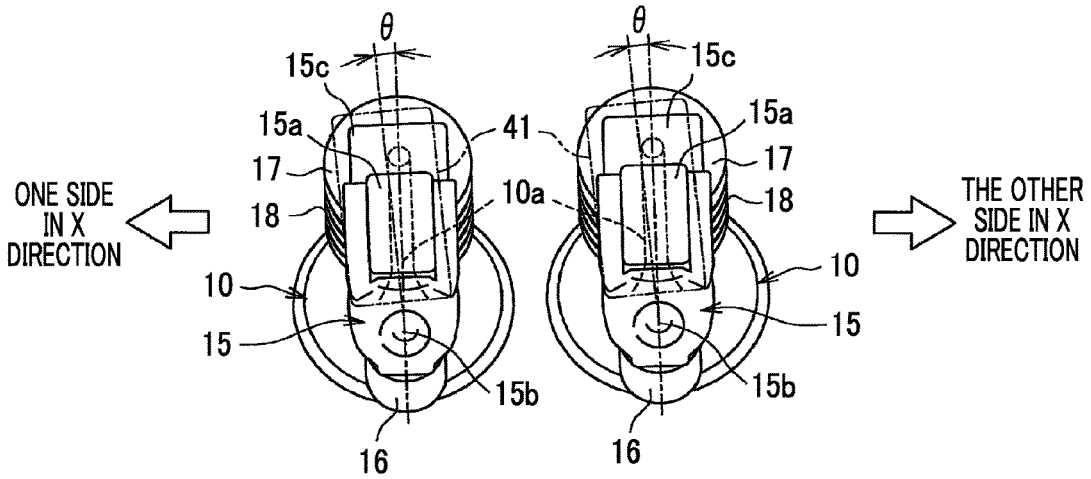
FIG. 7 is an explanatory view that exaggeratedly shows the positional relationship between each rocker arm and a corresponding one of the cams when viewed from above a cylinder head.

The rocker arm 15 that rocks in that way is arranged so as to be parallel to the cam indicated by the imaginary line (the low-lift cam 41 in FIG. 7; hereinafter, also simply referred to as cam 41), that is, so as to be perpendicular to the axis X (not shown in FIG. 7) of the intake camshaft 12 when viewed from above as shown in FIG. 7. However, actually, due to manufacturing tolerances, and the like, the cam 41 can be slightly inclined with respect to the rocker arm 15 as exaggeratedly shown in the drawing (the inclination angle is denoted by θ in the drawing).

If there is a misalignment with the cam 41 in this way, an unexpected slide of the cam unit 4 can occur under reaction force from the valve spring 18, which acts on the cam 41 via the rocker arm 15 and, by extension, the cam unit 4. That is, when the cam 41 rotates to rock the rocker arm 15 as described above, the cam 41 receives reaction force from the valve spring 18 via the rocker arm 15.

At this time, when the rocker arm 15 and the cam 41 are inclined with respect to each other as described above, the cam 41 is dragged in the direction of the axis X by the friction resistance between the rocker arm 15 and the cam 41 (in the present embodiment, the rolling resistance between the cam 41 and the roller 15*a*). In other words, the valve spring reaction force that acts on the cam 41 and, by extension, the cam unit 4, via the rocker arm 15 includes a component in the axis X direction. Thus, sliding force is added to the cam unit 4.

The magnitude of sliding force that is added to the cam unit 4 may be regarded as being proportional to the magnitude of friction resistance, so the sliding force increases as the reaction force from the valve spring 18 increases. The sliding amount may be expressed by (Perimeter of Cam 41)×tan θ by using the inclination angle θ between the rocker arm 15 and the cam 41. The sliding amount increases as the inclination angle θ increases.

In the present embodiment, since the cams 41 corresponding to the two intake valves 10 in the cam unit 4 for each cylinder 3 are ground as one at the same time (this also applies to the cams 42), inclination with respect to the rocker arm 15 similarly occurs, and the direction of the drag at each of the two rocker arms 15 is the same. For this reason, sliding force that acts on the cam 41 and, by extension, the cam unit 4, tends to increase. If the sliding force overcomes the holding force of the lock mechanism 6, an unexpected slide of the cam unit 4 occurs.

In contrast, for example, it is also conceivable that the spring constant of the coil spring 62 of the lock mechanism 6 is increased or the annular grooves 43*a*, 43*b* into which the lock balls 61 are fitted are deepened. However, this increases resistance at the time of causing the cam unit 4 to slide in order to change the cams 41, 42, with the result that an engine rotation speed that is an upper limit for changing the cams 41, 42 decreases. In addition, the coil spring 62 is used in a high-stress state, so there is a concern that the durability of the coil spring 62 decreases.

In consideration of such a situation, in the present embodiment, arrangement of the two rocker arms 15 for each cylinder 3 is devised such that reaction force that acts on the cam unit 4 from the valve spring 18 and reaction force that acts on the cam unit 4 from the other valve spring 18 are set in the opposite directions along the axis X direction. With this configuration, since sliding forces that act on the cam unit 4 via the corresponding two rocker arms 15 are cancelled, an unexpected slide of the cam unit 4 is suppressed.

Figure 8:
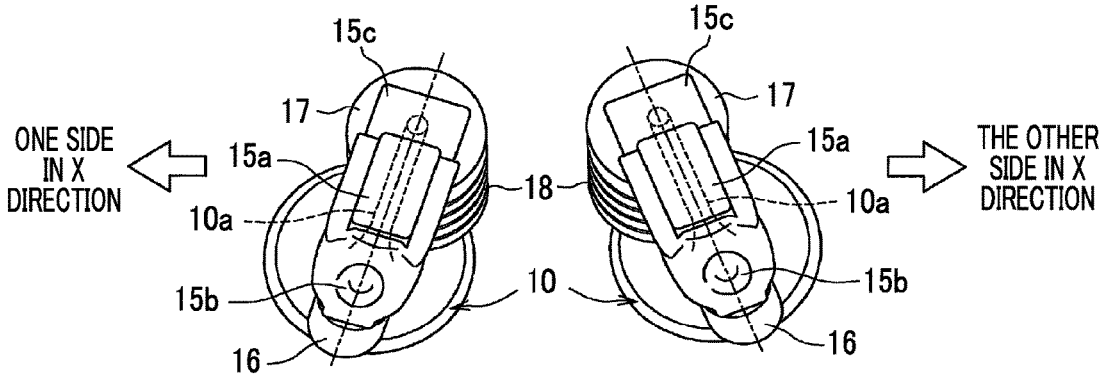
FIG. 8 is a view that exaggeratedly shows the inclined arrangement of rocker arms according to the embodiment, and that corresponds to FIG. 7.

Specifically, as shown in FIG. 8 as an example, in the present embodiment, the support portion 15*b* of any one (the left side in the example of the drawing) of the two rocker arms 15 for each cylinder 3 deviates to one side (the left side in the drawing) in the axis X direction with respect to the distal end portion 15*c*, and the support portion 15*b* of the other one (the right side in the example of the drawing) of the rocker arms 15 deviates to the other side (the right side in the drawing) in the axis X direction with respect to the distal end portion 15*c*. In this way, the support portions 15*b* form a divergent shape in the drawing.

With this configuration, the valve spring reaction force that is input to the distal end portion 15*c* of the one of the rocker arms 15 and that acts on the cam 41 or the cam 42 (not shown in FIG. 8) as the rocker arm 15 rocks includes a component oriented toward one side in the axis X direction. The valve spring reaction force that acts on the cam 41 or the cam 42 via the other one of the rocker arms 15 includes a component oriented toward the other side in the axis X direction. Thus, both valve spring reaction forces cancel out each other.

Figure 9:
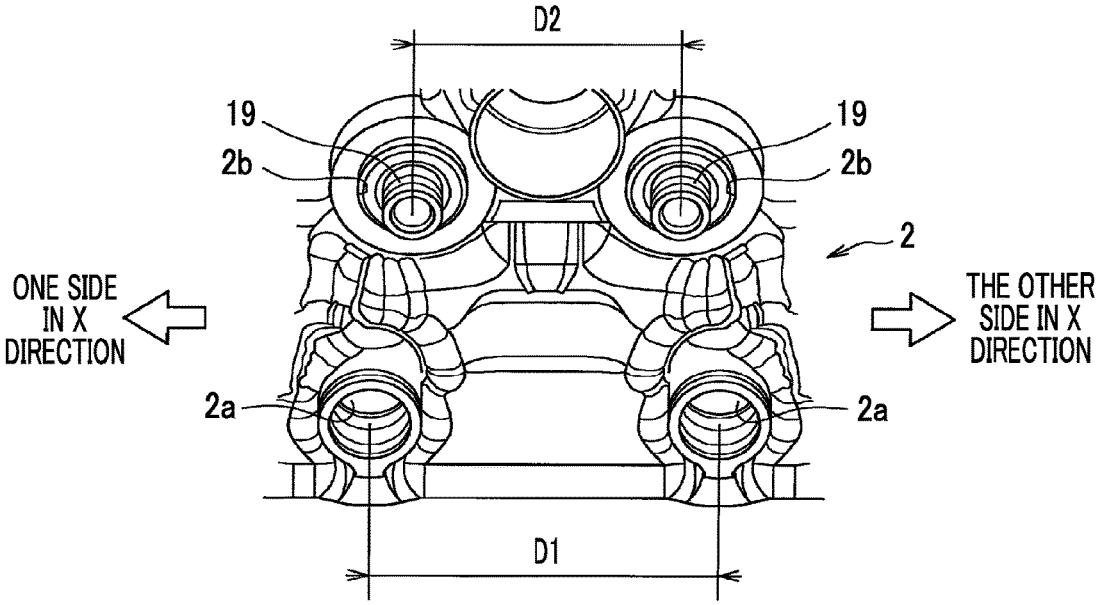
FIG. 9 is a view that exaggeratedly shows the positional relationship between valve insertion holes and adjuster mounting holes.

In order to lay out the two rocker arms 15 in that way, in the present embodiment, when the cylinder head 2 is viewed from above as shown in FIG. 9 as an example, the positional relationship among adjuster mounting holes 2*a* and insertion holes for the two intake valves 10 is set as follows. The two lash adjusters 16 for each cylinder 3 are mounted in the adjuster mounting holes 2*a*. The insertion holes for the two intake valves 10 are valve insertion holes 2*b* through which the stems 10*a* of the intake valves 10 are inserted. The valve guide 19 of the intake valve 10 is fitted into each valve insertion hole 2*b*.

In FIG. 9, the adjuster mounting hole 2*a* at one side (the left side in the drawing) in the axis X direction deviates to one side in the axis X direction with respect to the valve insertion hole 2*b*, and the adjuster mounting hole 2*a* at the other side (the right side in the drawing) deviates to the other side in the axis X direction with respect to the valve insertion hole 2*b*. Thus, the distance D1 between the centers of the two adjuster mounting holes 2*a* is longer than the distance D2 between the centers of the two valve insertion holes 2*b* (the centers of the valve guides 19).

Generally, in the engine 1 as described in the present embodiment, the layout of the two intake valves 10 for each cylinder 3 is determined on the basis of the configuration of a corresponding combustion chamber, with the result that the distance D2 between the two valve insertion holes 2*b* is determined. If the distance D1 between the two adjuster mounting holes 2*a* is increased with respect to the distance D2, interference between the adjuster mounting holes 2*a* and the intake ports (not shown in FIG. 9) is easily avoided, so the flexibility of the shape and layout thereof increases.

In the above-described engine 1 according to the present embodiment, in the case where the cam changing mechanism that changes the two cams 41, 42 by sliding the cam unit 4 mounted on the intake camshaft 12 is provided, when the rocker arms 15 corresponding to the two intake valves 10 for each cylinder 3 are arranged so as to be inclined in opposite directions, reaction force that acts on the cam unit 4 from the valve spring 18 and reaction force that acts on the cam unit 4 from the other valve spring 18 act in opposite directions along the axis X direction and cancel out each other. Thus, it is possible to suppress an unexpected slide of the cam unit 4 due to valve spring reaction force.

Other Embodiments

The configuration of the disclosure is not limited to those described in the above embodiment. The embodiment is only illustrative, and the application, and the like, of the configuration of the disclosure are, of course, not limited. For example, in the embodiment, the low-lift cam 41 and the high-lift cam 42 are provided in the cam unit 4 for each intake valve 10, and the lift characteristic is switched in high and low two steps; however, the disclosure is not limited to this configuration. For example, the lift characteristic may be switched in three steps.

In the embodiment, the cam units 4 for the first and second cylinders 3 (#1, #2) are integrally coupled to each other by the sleeve 43, and, similarly, the cam units 4 for the third and fourth cylinders 3 (#3, #4) are also integrally coupled to each other; however, the disclosure is not limited to this configuration. The cam units 4 for the first to fourth cylinders 3 (#1 to #4) may be configured to slide independently of one another. In this case, each guide groove 44 may have various known shapes, such as a Y-shaped guide groove described in JP 2010-520395 A.

In the embodiment, in order to cancel out valve spring reaction forces that act on the cam unit 4 via the two rocker arms 15 for each cylinder 3 in the axis X direction, those two rocker arms 15 are inclined in opposite directions and are arranged so as to form a divergent shape in FIG. 9. Instead, the state of inclination of the two rocker arms 15 may be an inverted divergent shape in FIG. 9.

Figure 10:
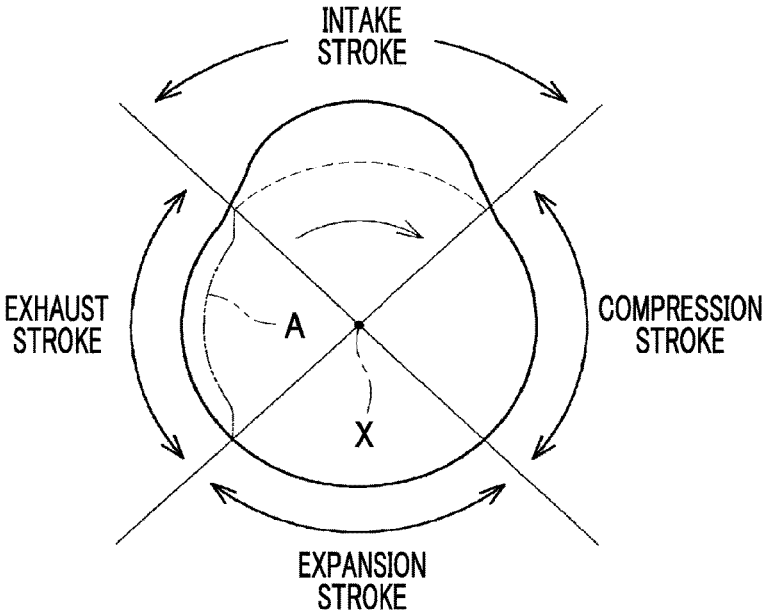
FIG. 10 is an explanatory view of a cam profile according to another embodiment in which a relatively small-diameter section is provided in a base circle section of each cam.

In order to suppress a drag of the cam 41 or cam 42 under the friction resistance between the cam 41 or cam 42 and the rocker arm 15, it is effective to devise the cam profile. That is, as shown in FIG. 10 as an example, a section A (indicated by the imaginary line in the drawing) having a smaller diameter than the base circle is provided within an angular range corresponding to the exhaust stroke of the cylinder 3 in the base circle section of the cam profile.

With this configuration, the friction resistance with the rocker arm 15 reduces in the small-diameter section, and a drag of the cam 41 or cam 42 is suppressed, so an unexpected slide of the cam unit 4 is difficult to occur. In an exhaust stroke, even when the degree of sealing of the intake valve 10 decreases in the small-diameter section, no inconvenience occurs. In FIG. 10, the entire angular range corresponding to the exhaust stroke of each cylinder 3 is set as the small-diameter section. Instead, part of the angular range corresponding to the exhaust stroke may be set as the small-diameter section.

Furthermore, in the embodiment, the example in which the cam changing mechanism is provided at the intake side in the valve actuating system of the engine 1 is described. Instead, the cam changing mechanism may be provided at the exhaust side or may be provided at both sides. The engine 1 is not limited to an in-line four-cylinder engine. The engine 1 may be an in-line two-cylinder, three-cylinder, five-cylinder or more. The disclosure is applicable to not only an in-line engine but also various cylinder arrangement engine, such as a V-engine.

The disclosure is able to suppress an unexpected slide of a cam unit due to reaction force from a valve spring in a cam-changing variable valve mechanism provided in a valve actuating system of an engine, and is highly effective when applied to, for example, an engine mounted on an automobile.

What is claimed is:

1. A variable valve mechanism mounted on a multi-cylinder engine, the variable valve mechanism comprising:

a cam unit fitted around a camshaft, the cam unit including two sets of a plurality of cams, one cam of the plurality of cams being selected by sliding the cam unit in an axial direction, two gas exchange valves provided for each cylinder; and first and second rocker arms, each of the two gas exchange valves configured to be driven by the selected cam of the plurality of cams via a corresponding rocker arm of the first and second rocker arms, wherein each rocker arm has a proximal end and a distal end, the proximal end is rockably supported by a cylinder head of the engine, the distal end is configured to press a stem of a corresponding one of the two gas exchange valves, the proximal end of the first rocker arm for each cylinder is offset to a first side in the axial direction of the camshaft with respect to the distal end of the first rocker arm, and the proximal end of the second rocker arm for each cylinder is offset to a second side opposite the first side in the axial direction of the camshaft with respect to the distal end of the second rocker arm.

2. The variable valve mechanism according to claim 1, wherein the cylinder head has two mounting holes and two insertion holes for each cylinder, the first and second rocker arms are respectively supported by a lash adjuster mounted in each of the two mounting holes, the stems of the two gas exchange valves are respectively inserted through the two insertion holes, and a distance between centers of the two mounting holes for each cylinder is greater than a distance between centers of the two insertion holes for each cylinder.

3. The variable valve mechanism according to claim 1, further comprising a plurality of cam units such that the cam units respectively corresponding to adjacent cylinders are integrated with each other.

4. The variable valve mechanism according to claim 1, wherein a section having a smaller diameter than a base circle of a cam profile of each cam is provided within an angular range corresponding to an exhaust stroke of a corresponding cylinder in a base circle section of the cam profile.

5. The variable valve mechanism according to claim 1, wherein the two gas exchange valves are two intake valves or two exhaust valves.

* * * * *